US008292752B2

(12) United States Patent
Wise et al.

(10) Patent No.: US 8,292,752 B2
(45) Date of Patent: Oct. 23, 2012

(54) APPARATUS AND METHOD FOR ASSISTING A GOLFER TO PROPERLY GRIP A GOLF CLUB

(76) Inventors: Larry M. Wise, Center Valley, PA (US); Glenn Orem, Hockessin, DE (US); Paola Versano-Bendinelli, Broomall, PA (US)

( * ) Notice: Subject to any disclaimer, the term of this patent is extended or adjusted under 35 U.S.C. 154(b) by 4 days.

(21) Appl. No.: 12/768,663

(22) Filed: Apr. 27, 2010

(65) Prior Publication Data

US 2011/0263346 A1 Oct. 27, 2011

(51) Int. Cl.
*A63B 69/36* (2006.01)
*A63B 53/14* (2006.01)
*A41D 19/00* (2006.01)

(52) U.S. Cl. ..... 473/205; 473/409; 2/161.2

(58) Field of Classification Search ..... 473/201, 473/203, 205, 206, 300–303, 458, 409, 464, 473/549, 551; 2/161.1, 161.2, 161.3
See application file for complete search history.

(56) References Cited

U.S. PATENT DOCUMENTS 3,532,344 A 10/1970 Masstab
3,848,874 A 11/1974 Elkins, Jr.
4,962,547 A 10/1990 Minnick
5,232,225 A 8/1993 Snyder
5,427,376 A * 6/1995 Cummings et al. ..... 473/201
5,462,280 A 10/1995 Dickerson
5,704,065 A 1/1998 Feuerhake
5,836,828 A 11/1998 Sinton
6,272,686 B1 8/2001 Liu
6,698,027 B2 3/2004 Park
7,083,524 B2 8/2006 Daniels
7,101,286 B2 9/2006 Oury
2007/0243940 A1 10/2007 McCree et al.
2008/0109936 A1 5/2008 Lumpiesz
2009/0170621 A1 7/2009 Evans
2009/0217441 A1 9/2009 McCree et al.

* cited by examiner

*Primary Examiner* — Nini Legesse
(74) *Attorney, Agent, or Firm* — Muskin & Cusick, LLC; Shawn R. Farmer

(57) ABSTRACT

The present device relates to an apparatus and a method for allowing a golfer to properly grip a golf club. A proper grip is one that allows for the most efficient radial deviation (abduction) and ulnar deviation (adduction) as well as flexion and extension of the wrist of the golfer's upper hand, while also minimizing club head and shaft axis rotation during a golf swing. This grip can be achieved through the use of a marking system comprising the golfer's glove and the grip of the golf club. By matching one or more markings on the glove, placed in specific locations on its anterior, with one or more markings located on specific positions on a golf club grip, the proper location of the golfer's upper hand can be found and the proper grip can then be made.

19 Claims, 4 Drawing Sheets

APPARATUS AND METHOD FOR ASSISTING A GOLFER TO PROPERLY GRIP A GOLF CLUB

FIELD OF THE INVENTION

The present device is a system comprising a golf glove and golf club grip further comprising markings to be used by golfers to ensure the attainment of a proper hand position when gripping a golf club. This golf glove and golf club grip marking system can allow a golfer to consistently align his or her hands into the proper position on the golf club through the use of visual cues. The markings on the golf glove and golf club grip can be minimal, and therefore, not easily visible to anyone that is not using this marking system or familiar with it.

BACKGROUND

The present device relates to an apparatus and method for assisting a golfer to attain the proper grip of a golf club. Although golfers typically use both hands when swinging a golf club, the hand that is closest to the end of the golf club and closest to the golfer's body, hereinafter referred to as the "upper hand," is the one primarily responsible for properly gripping the golf club. Therefore, the primary purpose of the present device and method is to properly align a golfer's upper hand to achieve a proper grip of a golf club. A proper grip by the upper hand is one that allows for the most efficient radial deviation (abduction) and ulnar deviation (adduction) as well as flexion and extension of the wrist, while also minimizing club head or shaft axis rotation during a golf swing. The existing prior art references teach a golf grip wherein the club rests low across the hand nearly parallel with the knuckles. However, a proper grip can only be achieved by correctly positioning the golf club grip in relation to the pisiform and triquetrum carpel bones of the golfer's hand, which can create a grip that is substantially different than that described in the existing prior art. The location of these bones is important, because when they are positioned correctly, the wrist of the upper hand of the golfer is locked in the proper position and cannot rotate about the club's longitudinal axis. Rotation about the longitudinal axis of the golf club can cause the face of the club to contact the golf ball at improper angles, which can change with each swing, preventing the golfer from taking corrective measures. When the pisiform and triquetrum carpel bones of the golfer's upper hand are in the correct location on the club, the face of the golf club will contact the ball at a predictable angle with every swing. Striking a golf ball with a club face at a proper angle is required for the ball to travel the direction and distance intended by the golfer.

Golf gloves are commonly used to prevent the golf club from slipping in the golfer's hands. These gloves are typically made from a material such as leather, which creates friction when placed in contact with the grips typically found on a golf club where the golfer places his or her hands when gripping it. In addition to this anti-slip function, the golf glove can also be a useful tool for indicating the precise location where a golfer should grip a golf club because golfers typically wear a golf glove on his or her upper hand. Likewise, golf club grips are typically found on all types of golf clubs and can also be a useful tool for indicating the precise location where a golfer should grip a golf club. The grips comprising the present marking system can be placed on clubs when they are manufactured or retrofitted onto clubs that did not originally comprise these marked grips. By providing visual cues on the golf glove, and corresponding visual cues on the grips of golf clubs, a golfer can consistently obtain the proper grip on a club, which can lead to predictable shots and a more effective technique.

Several different golf gloves have been designed, which use a visual indication on the surface of the glove to help the golfer find a particular hand position. Additionally, several different golf glove designs have been created, which contain padding and other means that force the user to place the club into a specific position in his or her hand.

A related invention, Liu U.S. Pat. No. 6,272,686, describes a golf glove comprising a "... guide line drawn diagonally at an angle of 20-30 degrees from a horizontal line across the upper surface of the golf glove, the guide line passing through the crook between the roots of the middle finger and the ring finger." This invention also describes an "indicium on a golf club grip handle." The method described by Liu involves lining up the golf club grip handle with the guide line on the golf glove. The golfer can then check the position of the club before taking his or her swing by ensuring that the indicium on the golf club grip handle is in line with the guide line. The Liu invention uses a somewhat similar apparatus and method as that described by the current apparatus and method. However, the grip that is created by the Liu apparatus and method described are not the same as those described herein. Specifically, the Liu's invention does not properly align the pisiform and triquetrum carpel bones, which is a prerequisite for a golfer to obtain the most efficient grip. Furthermore, the Liu invention lines up the club with a guideline and positions the club using an indicia, which the user should position "approximately 180 degrees from the guideline." In one embodiment, the present device and method is more precise because it requires the connection of two sets of markings, which requires the hand to be in a particular position in relation to the club, which does not require the user to visually estimate an angle as required by the Liu invention.

Another related invention, Park U.S. Pat. No. 6,698,027, describes golf gloves that provide an "indication part" that allows a golfer to obtain a particular golf grip. Each glove in the pair comprises markings that can be used with other markings on the other glove and the golf club grip, which can show the golfer how to grip the club in a particular way. Specifically, these gloves contain an indication on the top side of the thumbs that point to the Golfer's left shoulder when the hands are in the correct location. Additionally, these gloves comprise pressure points built into the gloves to help the golfer obtain a certain grip. Finally, these gloves comprise a visual cue that runs across the palm of the left hand, which represents the "holding line" where the shaft of the club should lie. However, the pressure points may affect the ability of the golfer to hit the ball correctly because they may force the golfer not to move his or her hand in a natural motion during the swing. Furthermore, the gloves contain a marking on the back of the glove, which does not allow the golfer to see the exact positioning of the contact point between the gloves and the grip. Moreover, these gloves show how the shaft can lie across the palm, but this method does not address the proper location of the pisiform and triquetrum carpel bones, which is required for obtaining the most efficient and consistent grip.

Another related invention, Elkins, Jr. U.S. Pat. No. 3,848,874, existing in the prior art describes a "golf glove system and method." This system and method comprises golf gloves containing a symbol on the external portion of the thumb of the upper hand, which ensures that the golfer obtains a certain thumb position on the club. The system comprises a marking on the top of the thumb that is visible to the golfer and a corresponding marker on the grip of the club. The golfer knows that the thumb is in the predetermined position when the marking on the glove lines up with the marking on the club. This patent allows the golfer to obtain a certain thumb position, but does not address the location of the club within the palm. Furthermore, these gloves do not present any relationship between the carpel bones of the hand and the shaft of the club. Moreover, the markings are located on the back of the glove, which does not allow the contact point between the glove and the club to be precisely identified by the user.

A fourth related invention, Sinton, U.S. Pat. No. 5,836,828, existing in the prior art describes a "Golf Training System." This training system involves the use of one or two golf gloves to aid the golfer in finding a certain grip on the golf club. The glove that is worn on the upper hand has indications on the thumb as well as the index finger, which allows the golfer to visualize the predetermined hand placement. The second glove is optional and can be worn on the lower hand. This glove comprises two dot indicators on top of the knuckles, which indicate the line where the club should be located across the palm. This glove also contains indicators that show how to place the lower hand in relation to the upper hand. As in the other existing art, this glove system does not contain any indicators that allow the golfer to achieve the correct location of the carpel bones in the hand. Additionally, this system still comprises the drawback that the indicators are located on the back side of the hand, which prevents the golfer from viewing the precise contact point between the golfer's hand and the club's grip.

Finally, a related invention, McCree, U.S. Patent Application No. 2007/0243940, existing in the prior art describes a "Golf Grip System." This golf grip system comprises a glove and a golf grip that each further comprises indicators to help a golfer achieve a predetermined hand position with relation to the golf club. The thumb of the glove on the upper hand has an indicator that is generally oval in shape and is located directly over the pad of the golfer's thumb. There is a corresponding oval marking on the grip of the club and the two marks are placed in contact with each other for the predetermined thumb position to be obtained. In addition to this indicator, there is a line that crosses the palm of the glove. This line indicates the location where the club should be located within the hand. As with most of the inventions listed above, this invention uses a line that is placed in contact with the club shaft to establish a particular club position with relation to the upper hand. The line is specifically located at the location where the fingers are joined with the palm of the hand. This invention comprises indicators on the glove which contact indicators on the club. However, this invention does not address the location of the carpel bones within the hand. The line that shows the location of the club across the palm does not have any relation to where the carpel bones should be located and does not facilitate their proper alignment.

What is needed is a golf glove and golf club grip marking system that provides an indication as to where the hand should contact the golf club grip in order to properly align the pisiform and triquetrum carpel bones in relation to the golf club. This system may also indicate where the golfer's index finger should contact the golf club; thereby forming a grip that is efficient and capable of being maintained throughout a golfer's swing and repeatable time after time. The markings on the golf glove should be discrete and located on the palm of the glove so that contact between the marks on the glove and the golf club grip can be visually confirmed and precise positioning can thereby be achieved.

SUMMARY OF THE INVENTION

It is an aspect of the present device to provide a golf glove and golf club grip system and method to help improve a golfer's swing.

The above aspect can be obtained by an apparatus that includes: a golf glove comprising a first glove marking, which when worn on a hand is located directly below the pisiform and triquetrum carpal bones when the hand is held in a handshake position and a second glove marking that is on the anterior of the joint where the first and second phalanges meet or slightly into the intermediate phalanges of the index finger; and a golf club grip, the golf club grip further comprising a first grip marking on its top near the end of the golf grip and a second grip marking on its bottom at a distance far enough down the golf club grip to line up with second glove marking.

The above aspect can be obtained by a method for properly gripping a golf club, the method comprising: providing a golf glove comprising a first glove marking, which when worn on an upper hand is located directly below the pisiform and triquetrum carpal bones when the upper hand is held in the handshake position and a second glove marking that is on the anterior of the joint where the first and second phalanges meet or slightly into the intermediate phalanges of the index finger; providing a golf club comprising a golf club grip, the golf club grip further comprising a first grip marking at its top and a second grip marking on its bottom at a distance far enough down the golf club grip to line up with second glove marking; placing the golf glove onto the golfer's upper hand; and grasping the golf club grip with the gloved upper hand while placing the first glove marking into contact with the first grip marking and placing the second glove marking into contact with the second grip marking.

The above aspect can also be obtained by a system that comprises a first glove marking and a corresponding first grip marking. As above, the glove to be worn on the upper hand can contain a first glove marking located slightly forward and exterior to the pisiform and triquetrum carpel bones on the palm of the hand. This location corresponds to a vertical line extending down from the first glove marking, between the ring and pinky fingers of the hand to the ground when the hand is properly gripping a golf club or in the handshake position. In this system, the glove comprises no additional mark on the index finger. Instead, the golf club is allowed to rest in the crook of the index finger at a location that is approximately two thirds of the way up the finger as measured from the connection of the finger to the palm up to the tip of the finger. This location corresponds to location on the finger where the bottom most location of the grip rests on the finger when the club is held with the first glove marking in contact with its corresponding first grip marking.

The above aspect can also be obtained by a method for properly gripping a golf club, the method comprising: providing a golf glove comprising a first glove marking, which when worn on a hand is located directly below the pisiform and triquetrum carpal bones when the hand is held in the handshake position; providing a golf club comprising a golf club grip, the golf club grip further comprising a first grip marking on its top near the end of the golf grip; placing the golf glove onto the golfer's upper hand; and grasping the golf club grip with the gloved upper hand while placing the first glove marking into contact with the first grip marking of the golf club grip and placing the golf club grip into the crook of the index finger of the golfer's upper hand.

These, together with other aspects and advantages, which will subsequently become apparent, and reside in the details of construction and operation as more fully hereinafter described and claimed, reference being had to the accompanying drawing forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
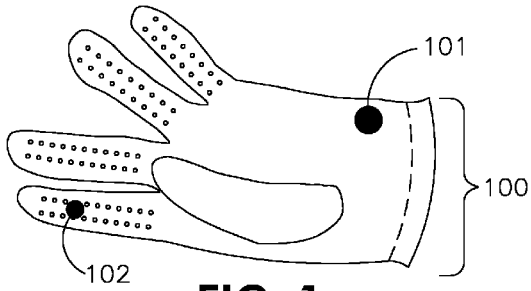
FIG. 1 is a top view of the anterior side of a golf glove comprising a first glove marking and a second glove marking according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

The general inventive concept can provide an indication as to where the golf grip should be made so that the pisiform and triquetrum carpal bones of a golfer's upper hand are located in the proper position in relation to the golf club. Additionally, it can indicate the proper location of the fingers around the club, making a grip that is efficient and capable of being maintained throughout the golfer's swing. The markings on the glove can be discrete and located on the inner or anterior surface of the hand so that contact between the marks can be visualized and precise positioning can easily be achieved.

A first glove marking and a second glove marking can be provided and a corresponding first grip marking and second grip marking can be provided on a grip of a golf club. This golf glove can be any suitable glove that can be used in the sport of golf that comprises the first glove marking and second glove marking and can be worn on the upper hand of the golfer. (For right-handed golfers, this it usually the left hand and for left-handed golfers this is usually the right hand.) Likewise, the grip comprising this invention can be any standard golf club grip capable of comprising the markings mentioned above.

The first glove marking can be located slightly forward and exterior to the pisiform and triquetrum carpel bones on the palm of the hand. The location of this first glove marking also corresponds to a vertical line extending down to the ground from the first glove marking and running between the ring and pinky fingers of the upper hand when it is properly gripping a golf club or in the handshake position. A second glove marking can be located on the index finger of the golf glove and can be located approximately two thirds of the way up the finger as measured from the connection of the finger to the palm up to the tip of the finger. This location corresponds to a location on the finger where the second grip marking can rest on the index finger when the club is held with the first glove marking in contact with its corresponding first grip marking.

The golf club grip can comprise a first grip marking and a second grip marking that correspond to the two glove markings comprising the golf glove. The first grip marking corresponding to the mark on the palm of the golf glove can be located within a few inches of the top of the golf club grip. The second grip marking can be located on the underside of the golf club grip at a distance from the top of the grip where the index finger can comfortably contact the club when the first glove marking on the palm of the glove is placed into contact with its corresponding first grip marking. The line that connects the first glove marking on the palm of the glove with the second glove marking on the index finger of the glove can be referred to as the "contact line" And corresponds to the position on the glove that aligns with the longitudinal axis of the golf club shaft. The angle of the contact line can range from approximately fifty-five degrees to approximately seventy degrees from a line running perpendicular to the glove and through the second glove marking depending on the individual golfer using the system. This angle is considerably greater than that of comparable contact lines described in the prior art.

By using this system to align the club correctly in the golfer's hand, the golf club can be held in the most anatomically correct and efficient position. When the golf club is lifted with the upper hand alone and the hand is held in the position that is used when shaking another person's hand, the "handshake position," the weight of the club shaft and club head is primarily supported by the pisiform and triquetrum carpel bones at the location where the first glove marking is directly above the first grip marking at the top of the golf club grip. Additionally, the second glove marking on the index finger of the golf glove can be placed into contact with the second grip marking on the underside of the grip along the shaft axis. This assures the best grip position and allows for the most efficient and best anatomical abduction, adduction, flexion and extension of the wrist during the swing motion, while minimizing club head or shaft rotation while the golfer is swinging his or her club.

In an alternative embodiment, the system can comprise a golf glove with only one first glove marking and a golf club grip comprising only one first grip marking. The first glove marking can be placed into contact with e first grip marking as described above, but the position of the index finger in relation to the golf club grip is determined by allowing the club to rest in the crook of the index finger after the first glove marking is placed into contact with e first grip marking.

By using either of the two systems described above, a golfer can achieve the most anatomically correct position for his or her hands on the club, namely one which correctly positions the golf club grip in relation to the pisiform and triquetrum carpel bones of the golfer's hand. This system allows the golfer to repeatedly find the proper hand placement, which minimizes one of the main variables that can affect the consistency of the swing, namely, the longitudinal rotation about the shaft of the golf club. Additionally, because the marks are located on the inside of the upper hand they can be placed into direct contact with the marks on the grip and their positions can be visually confirmed, ensuring that the proper upper hand placement is obtained.

FIG. 1 is a top view of the anterior side of a golf glove 100 comprising a first glove marking 101 and a second glove marking 102 according to an embodiment. Golfers typically wear only one golf glove and that glove is worn on the hand that grips the club closest to the end of its shaft, referred to as the "upper hand." When the golf glove 100 is worn on a golfer's upper hand, the first glove marking 101 can be located directly under the golfer's pisiform and triquetrum carpel bones when the hand is held in a "hand shake" position, which is approximately the same position that the hand is in when the golfer is addressing a golf ball at the point of contact between the clubface and the golf ball. The second glove marking 102 can be located on the anterior side of golf glove's index finger where the first and second phalanges connect or into the intermediate phalanges of the index finger. In an alternative embodiment, the golf glove 100 does not comprise a second glove marking 102.

A first glove marking 101 and a second glove marking 102 are shown as circles on the glove but any shape can be used to indicate these two positions. Furthermore, these markings can be printed, painted, stamped or stitched onto the glove's surface, or the markings can be created in any other suitable fashion that is known in the relevant art. Similarly, the glove can be made of leather, fabric or any other suitable material known to one of ordinary skill in the art of golf glove manufacturing.

Figure 2:
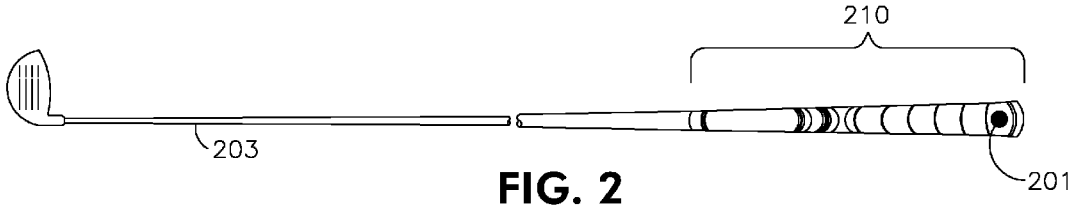
FIG. 2 is a top view of a golf club comprising a golf club grip, which comprises a first grip marking according to an embodiment.

FIG. 2 is a top view of a golf club 203 comprising a golf club grip 210 comprising a first grip marking 201 according to an embodiment. The 'top' of the golf club grip is defined here as the view of the grip by a golfer when addressing a golf ball and the face of the golf club is held at the proper angle, square to the line of play, required to strike a golf ball. When the golf club 203 is held in this position and the golfer's upper hand is in the "handshake" position, the first glove marking 101 on the golf glove 100 can be placed into contact with the first grip marking 201, wherein the first glove marking 101 should completely cover the first grip marking 201, which can be of comparable size and shape. The golf club grip 210 can be connected to a golf club 203 and the first grip marking 201 would be located at the opposite end of the golf club from the head of the club.

Figure 3:
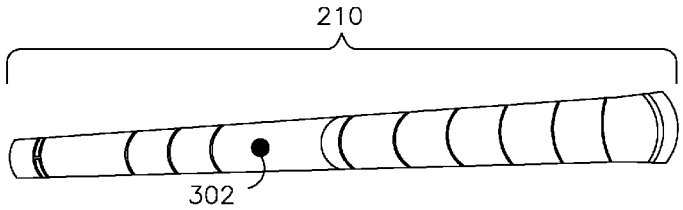
FIG. 3 is a bottom view of the golf club grip, comprising a second grip marking according to an embodiment.

FIG. 3 is a bottom view of the golf club grip 210 pictured in FIG. 2, which comprises a second grip marking 302 according to an embodiment. The 'bottom' of the golf club grip is defined here as the view of the grip from the ground when a golf club comprising the golf club grip is being held by a golfer addressing a golf ball and the face of the golf club is held at the proper angle, square to the line of play, required to strike the golf ball. The second grip marking 302 is located on the opposite side, 180 degrees from the first grip marking 201 along the longitudinal axis of the golf club and at a sufficient distance down the golf club grip such that the second grip marking 302 of the golf grip 210 can be placed into contact with the second glove marking 102 of the golf glove, wherein the second grip marking 302 of the golf grip can completely cover the second glove marking 102. In an alternative embodiment, the golf club grip 210 does not comprise a second grip marking 302.

Figure 4:
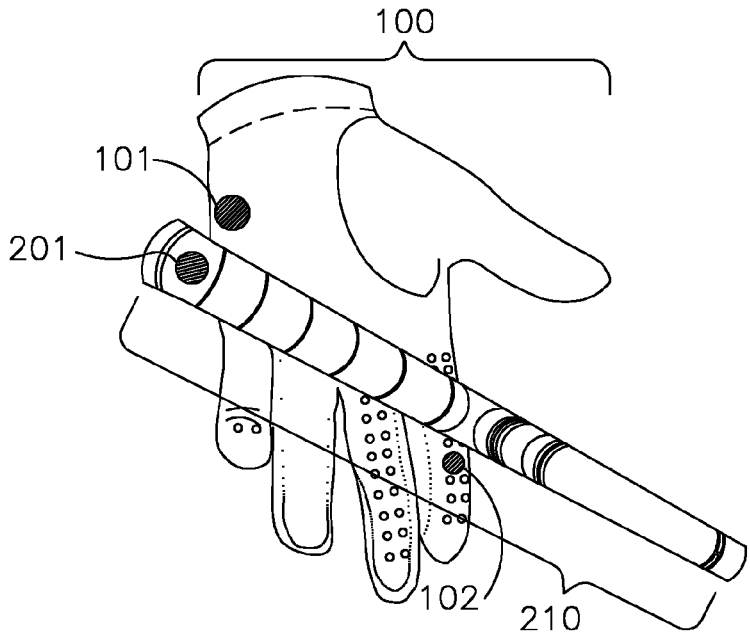
FIG. 4 is a perspective view of an upper hand wearing a golf glove that further comprises a first glove marking and a second glove marking, preparing to grip a golf club grip further comprising a first grip marking according to an embodiment.

FIG. 4 is a perspective view of an upper hand wearing a golf glove 100 that further comprises a first glove marking 101 and a second glove marking 102, preparing to grip a golf club grip 210 further comprising a first grip marking 201 and a second grip marking (not pictured) according to an embodiment.

Figure 5:
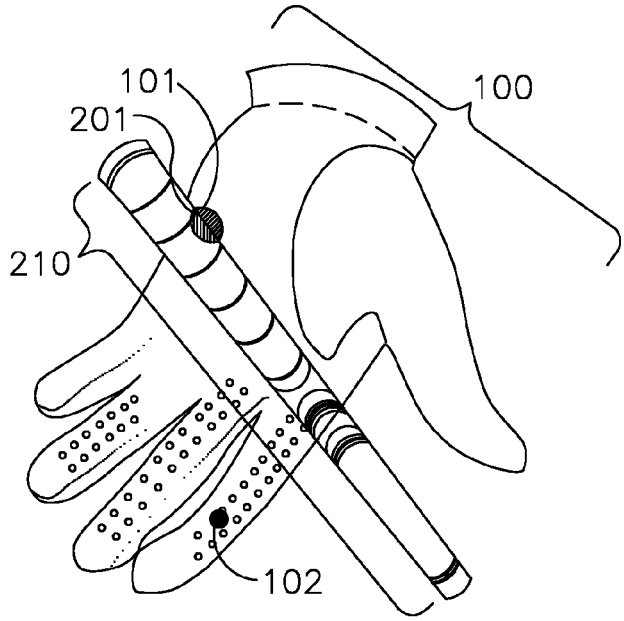
FIG. 5 is a perspective view of an upper hand, wearing a golf glove that further comprises a first glove marking and a second glove marking, preparing to properly grip a golf club grip further comprising a first grip marking, by connecting the first grip marking on the golf club to the first glove marking on a golf glove according to an embodiment.

FIG. 5 is a perspective view of an upper hand, wearing a golf glove 100 that further comprises a first glove marking 101 and a second glove marking 102, preparing to properly grip a golf club grip 210 further comprising a first grip marking 201, by placing into contact the first grip marking 201 with the first glove marking 101 according to an embodiment. The step of placing the first glove marking 101 into contact with the first grip marking 201 can be completed before placing the second grip marking 302 into contact with the second glove marking 102.

Figure 6:
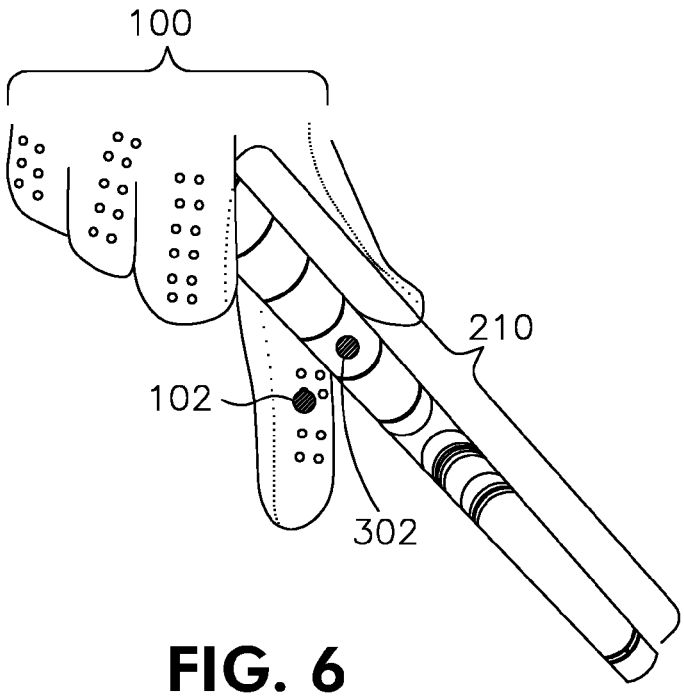
FIG. 6 is a partial perspective view of an upper hand wearing a golf glove, that further comprises a first glove marking and a second glove marking, properly holding a golf club grip that further comprises a first grip marking and a second grip marking, wherein the first grip marking is connected to the first glove marking and showing the second grip marking, which is to be connected to the second glove according to an embodiment.

FIG. 6 is a partial perspective view of an upper hand wearing the golf glove 100, that further comprises a first glove marking (not shown) and a second glove marking 102, preparing to properly grip a golf club grip 210 that further comprises a first glove marking (not shown) and a second glove marking 102, by placing into contact the first glove marking (not shown) to the first grip marking (not shown) and placing into contact the second grip marking 302 to the second glove marking 102 according to an embodiment. The step of placing the first glove marking of the golf glove into contact with the first grip marking of the golf club grip can be completed before placing the second grip marking 302 into contact with the second glove marking 102 on a golf glove 100.

Figure 7:
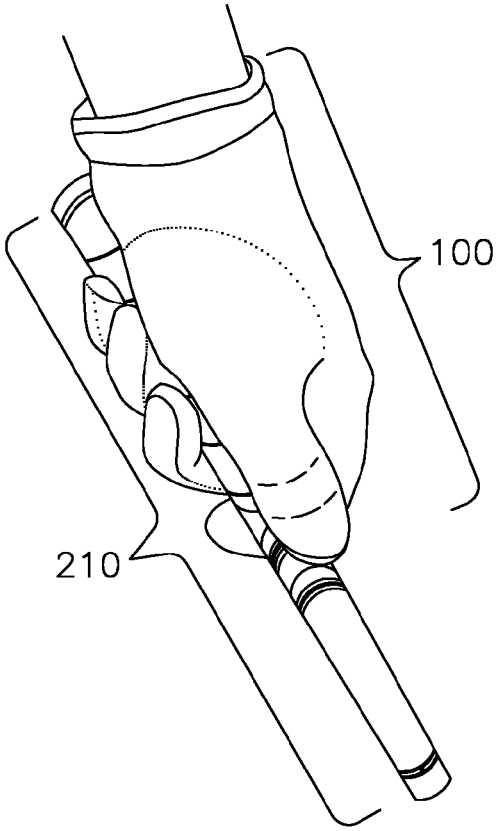
FIG. 7 is a perspective view of an upper hand wearing a golf glove, that further comprises a first glove marking and a second glove marking, properly holding a golf club grip that further comprises a first grip marking and a second grip marking, wherein the first grip marking is placed into contact with the first glove marking and showing the second grip marking placed into contact with the second glove marking according to an embodiment.

FIG. 7 is a perspective view of an upper hand wearing a golf glove 100, that further comprises a first glove marking (not shown) and a glove second marking (not shown), properly holding a golf club grip 210 that further comprises a first grip marking (not shown) and a second grip marking (not shown), wherein the first grip marking is placed into contact with the first glove marking and showing the second grip marking placed into contact with the second glove marking according to an embodiment. In an alternative embodiment, the golf glove 100 does not comprise a second glove marking and the golf club grip 210 does not comprise a second grip marking.

Figure 8:
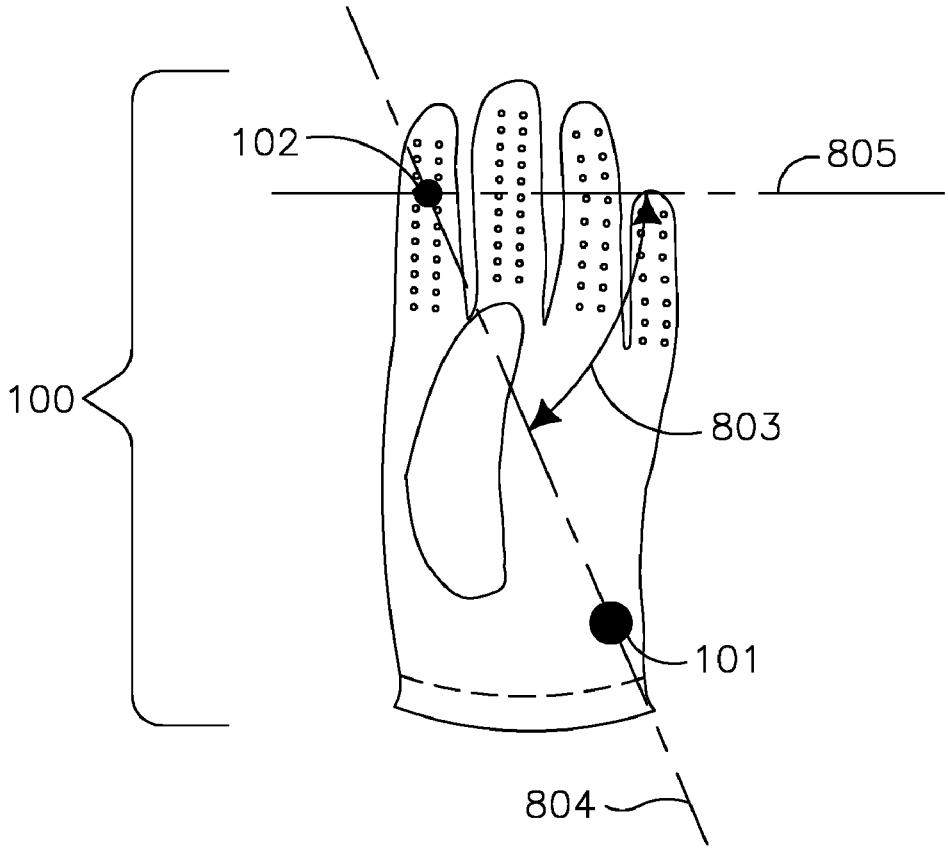
FIG. 8 is a top view of the anterior side of a golf glove comprising a first glove marking and a second glove marking, and a first line is shown running through the first glove marking and second glove marking, and a second line running perpendicular to the length of the glove and intersecting the first line at the second glove marking forming an interior angle according to an embodiment.

FIG. 8 is a top view of the anterior side of a golf glove 100 comprising a first glove marking 101 and a second glove marking 102, and a first line 804 is shown passing through the first glove marking 101 and second glove marking 102, and a second line 805 running perpendicular to the length of the golf glove 100 and intersecting the first line 804 at the second glove marking 802 forming an interior angle 803 according to an embodiment. This interior angle 803 can be fifty-five degrees to seventy degrees (55° to 70° wherein the longitudinal axis of the golf club, when gripped properly by an upper hand wearing the golf glove 100, would align with the first line 804 also referred to as the "contact line."

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An apparatus for properly aligning a golfer's upper hand onto a golf club to ensure a proper grip, the apparatus comprising:

a golf glove comprising a first glove marking on the golf glove's outer surface, which when worn on the upper hand is located directly below a pisiform carpal bone and a triquetrum carpal bone when the upper hand is held in a handshake position and a second glove marking that is on an anterior side of the joint where a first phalange and a second phalange meet or are slightly into an intermediate phalange comprising an index finger; and a golf club grip, the golf club grip further comprising a first grip marking on an outer surface located near a top of the golf club grip near an end of the golf grip and a second grip marking on an outer surface located near a bottom at a distance far enough down the golf club grip to line up with the second glove marking.

2. The apparatus as recited in claim 1, wherein the markings on the golf glove and golf club grip are printed onto the outer surfaces of the golf glove and golf club grip.

3. The apparatus as recited in claim 1, wherein the markings on the golf glove and golf club grip are painted onto the outer surfaces of the golf glove and golf club grip.

4. The apparatus as recited in claim 1, wherein the markings on the golf glove and golf club grip are stitched onto the outer surfaces of the golf glove and golf club grip.

5. The apparatus as recited in claim 1, wherein the markings on the golf glove and golf club grip are stamped onto the outer surfaces of the golf glove and golf club grip.

6. The apparatus as described in claim 1 wherein a first line passing through the first glove marking and second glove marking forms a 55° to 70° interior angle with a second line running perpendicular to a longest side the glove when worn on the golfer's upper hand and passing through the second glove marking and intersecting the first line at the second glove marking.

7. The apparatus as recited in claim 6, wherein the markings on the golf glove and golf club grip are printed onto the outer surfaces of the golf glove and golf club grip.

8. The apparatus as recited in claim 6, wherein the markings on the golf glove and golf club grip are painted onto the outer surfaces of the golf glove and golf club grip.

9. The apparatus as recited in claim 6, wherein the markings on the golf glove and golf club grip are stitched onto the outer surfaces of the golf glove and golf club grip.

10. The apparatus as recited in claim 6, wherein the markings on the golf glove and golf club grip are stamped onto the outer surfaces of the golf glove and golf club grip.

11. The apparatus as recited in claim 6, further comprising a golf club attached to the golf club grip, the golf club attached closer to the second golf club grip marking than the first golf club grip marking.

12. The apparatus as recited in claim 1, further comprising a golf club attached to the golf club grip, the golf club attached closer to the second golf club grip marking than the first golf club grip marking.

13. A method for properly gripping a golf club, the method comprising:

Providing a golf glove comprising a first glove marking, which when worn on a golfer's upper hand is located directly below a pisiform carpal bone and a triquetrum carpal bones when the upper hand is held in a handshake position and a second glove marking that is located on an anterior end of the joint where a first phalange and a second phalanges meet or slightly into intermediate phalanges comprising an index finger;

Providing a golf club comprising a golf club grip, the golf club grip further comprising a first grip marking on an outer surface near a top, near an end of the golf grip and a second grip marking on an outer surface near a bottom at a distance far enough down the golf club grip to line up with second glove marking;

placing the golf glove onto the golfer's upper hand; and grasping the golf club grip with the gloved upper hand while placing the first glove marking into contact with the first grip marking and placing the second glove marking into contact with the second grip marking.

14. An apparatus for properly aligning a first glove marking, located on an outer surface of the glove, which when worn on an uppers hand is located directly below pisiform carpal bone and a triquetrum carpal bones when the upper hand is held in a handshake position; and a golf club comprising a golf club grip, the golf club grip further comprising a first grip marking located on an outer surface of the golf club grip at a top near an end of the golf club grip.

15. The apparatus as recited in claim 14, wherein the markings on the golf glove and golf club grip are printed onto the outer surfaces of the golf glove and the outer surface of the golf club grip.

16. The apparatus as recited in claim 14, wherein the markings on the golf glove and golf club grip are painted onto the outer surfaces of the golf glove and the outer surface of the golf club grip.

17. The apparatus as recited in claim 14, wherein the markings on the golf glove and golf club grip are stitched onto the outer surfaces of the golf glove and the outer surface of the golf club grip.

18. The apparatus as recited in claim 14, wherein the markings on the golf glove and golf club grip are stamped onto the outer surfaces of the golf glove and the outer su ace of the golf club grip.

19. A method for properly gripping a golf club, the method comprising:

providing a golf glove comprising a first glove marking on the golf glove, which when worn on a golfer's upper hand is located directly below a pisiform carpal bone and a triquetrum carpal bones when the upper hand is held in a handshake position;

providing a golf club comprising a golf club grip, the golf club grip further comprising a first grip marking, located on an outer surface of the golf club grip, at a top near an end of the golf club grip;

Placing the golf glove onto the golfer's upper hand; and

Allowing the golfer to grasp the golf club grip with the gloved upper hand by placing the first glove marking into contact with the first grip marking and placing the golf club grip into crook of an index finger of a golfer's upper hand.

* * * * *